US010056686B2

(12) United States Patent
Park et al.

(10) Patent No.: US 10,056,686 B2
(45) Date of Patent: Aug. 21, 2018

(54) SHARK PIN ANTENNA

(71) Applicant: LG Innotek Co., Ltd., Seoul (KR)

(72) Inventors: Young Hun Park, Seoul (KR); Hye Sun Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 54 days.

(21) Appl. No.: 15/005,176

(22) Filed: Jan. 25, 2016

(65) Prior Publication Data

US 2016/0218430 A1 Jul. 28, 2016

(30) Foreign Application Priority Data

Jan. 23, 2015 (KR) ..... 10-2015-0011309

(51) Int. Cl.

| | |
|---|---|
| ***H01Q 1/32*** | (2006.01) |
| ***H01Q 5/307*** | (2015.01) |
| ***H01Q 1/52*** | (2006.01) |
| *H01Q 9/04* | (2006.01) |
| *H01Q 9/42* | (2006.01) |

(52) U.S. Cl.

CPC ..... *H01Q 5/307* (2015.01); *H01Q 1/32* (2013.01); *H01Q 1/3275* (2013.01); *H01Q 1/521* (2013.01); *H01Q 1/525* (2013.01); *H01Q 9/0414* (2013.01); *H01Q 9/42* (2013.01)

(58) Field of Classification Search

CPC ..... H01Q 1/3275

See application file for complete search history.

(56) References Cited

U.S. PATENT DOCUMENTS

| | | | |
|---|---|---|---|
| 6,225,954 | B1 | 5/2001 | Edvardsson et al. |
| 2002/0175879 | A1 | 11/2002 | Sabet et al. |
| 2006/0038726 | A1 | 2/2006 | Iacovella et al. |

(Continued)

FOREIGN PATENT DOCUMENTS

| | | | |
|---|---|---|---|
| CN | 102427170 | A | 4/2012 |
| CN | 103236590 | A | 8/2013 |

(Continued)

OTHER PUBLICATIONS

European Search Report dated Jun. 22, 2016 in European Application No. 16151986.3.

(Continued)

*Primary Examiner* — Graham Smith
*Assistant Examiner* — Noel Maldonado
(74) *Attorney, Agent, or Firm* — Saliwanchik, Lloyd & Eisenschenk

(57) ABSTRACT

A shark pin antenna is proposed, the shark pin antenna including a base, a circuit board mounted on the base, a 3G/4G antenna mounted at a first end of the circuit board and configured to receive a signal of 3G/4G band signal, an AM/FM antenna mounted at a second end of the circuit board and configured to receive AM/FM band signal, V2X antennas mounted at a lateral surface of the AM/FM antenna, each being spaced apart at a predetermined distance and configured to realize a V2X (Vehicle to Everything) communication, and a plurality of antennas positioned between the 3G/4G antenna and the AM/FM antenna to receive a band signal higher than the AM/FM band signal, but lower than the 3G/4G band signal.

12 Claims, 7 Drawing Sheets

(56) References Cited

U.S. PATENT DOCUMENTS

| | | | | |
|---|---|---|---|---|
| 2008/0001822 | A1* | 1/2008 | Vesterinen | H01Q 1/243 343/700 MS |
| 2012/0026050 | A1 | 2/2012 | Sampo et al. | |
| 2013/0229315 | A1* | 9/2013 | Duzdar | H01Q 1/3275 343/713 |
| 2013/0241798 | A1* | 9/2013 | Lee | H01Q 1/50 343/876 |
| 2014/0043204 | A1 | 2/2014 | Basnayake et al. | |
| 2014/0125531 | A1* | 5/2014 | Kaneko | H01Q 1/3275 343/713 |
| 2015/0061946 | A1* | 3/2015 | Martinez-Ortigosa | H01Q 9/0407 343/713 |

FOREIGN PATENT DOCUMENTS

| | | | |
|---|---|---|---|
| CN | 103579780 | A | 2/2014 |
| EP | 1471599 | A1 | 10/2004 |
| EP | 2833479 | A1 | 2/2015 |
| WO | WO-2009065806 | A1 | 5/2009 |
| WO | WO-2013/090783 | A1 | 6/2013 |

OTHER PUBLICATIONS

Office Action dated Apr. 2, 2018 in Chinese Application No. 201610041450.4.

* cited by examiner

SHARK PIN ANTENNA

CROSS-REFERENCE TO RELATED APPLICATION

This application claims the benefit under 35 U.S.C. § 119 of Korean Application No. 10-2015-0011309 filed Jan. 23, 2015, which is hereby incorporated by reference in its entirety.

BACKGROUND OF THE DISCLOSURE

Technical Field

The teachings in accordance with the exemplary embodiments of this present disclosure generally relate to a shark fin antenna, and more particularly, to a shark fin antenna formed with a plurality of antennas arranged to provide various wireless services.

Background

A conventional shark fin antenna is realized and used to communicate through two or three types of frequency bands out of AM, FM, T-DMB, GPS/Glonass/Galileo/XM/SIRIUS (hereinafter referred to as "Satellite Integrated Antenna"), Wave, Wi-Fi, and 3/4G.

The structure of the conventional shark fin antenna was difficult in obtaining isolation among antennas to make it difficult to provide a guarantee of performance over that of conventionally used independent antennas. Thus, it is difficult to obtain a guarantee of performance for a system, as a shark fin antenna is embedded with many kinds of antennas, such that 2-3 antennas are embedded to use a few frequency bands for communication.

The convention shark fin antenna, when embedded with a transmission system, has a difficulty in obtaining a guaranteed performance due to decreased performance of reception-only antenna, and that it is necessary to guarantee isolation among antennas and isolation between transmission and reception systems as well.

BRIEF SUMMARY

The present disclosure is designed to solve the problems of prior art, and it is an object of the present disclosure to provide a shark fin antenna formed with a plurality of antennas arranged to provide various wireless services.

In one general aspect of the present disclosure, there is provided a shark fin antenna, the antenna comprising:

a base;

a circuit board mounted on the base;

a 3G/4G antenna mounted at a first end of the circuit board and configured to receive a signal of 3G/4G band signal;

an AM/FM antenna mounted at a second end of the circuit board and configured to receive AM/FM band signal;

V2X antennas mounted at a lateral surface of the AM/FM antenna, each being spaced apart at a predetermined distance and configured to realize a V2X (Vehicle to Everything) communication; and a plurality of antennas positioned between the 3G/4G antenna and the AM/FM antenna to receive a band signal higher than the AM/FM band signal, but lower than the 3G/4G band signal.

Preferably, but not necessarily, the plurality of antennas may be mounted at a shade area, a space being that signals transmitted and received through the AM/FM antenna are non-existent.

Preferably, but not necessarily, the 3G/4G antenna may include two horizontally-arranged antennas of a main antenna and a sub antenna.

Preferably, but not necessarily, one of the V2X antennas may be arranged at a left side of the AM/FM antenna and the other V2X antenna may be arranged at a right side of the AM/FM antenna, each spaced apart at a predetermined distance.

Preferably, but not necessarily, the AM/FM antenna may include a spring assembly vertically mounted at the circuit board, a metal antenna coupled to the spring assembly and a magnetic substance positioned at a bottom surface of the metal antenna.

Preferably, but not necessarily, the spring assembly may include a coil spring, a bottom electric conductor coupled to a bottom surface of the coil spring to receive, from the circuit board, a current necessary for radiation, and an upper electric conductor coupled to an upper surface of the coil spring and connected to the magnetic substance.

Preferably, but not necessarily, the metal antenna may be configured in a manner such that a part of the metal antenna rises upwards by being bent in a U shape or a V shape.

Preferably, but not necessarily, the plurality of antennas may include a satellite integrated antenna mounted between the 3G/4G antenna and the AM/FM antenna to receive a signal of satellite frequency band.

Preferably, but not necessarily, the plurality of antennas may include a DMB (Digital Multimedia Broadcasting) antenna mounted between the satellite integrated antenna and the AM/FM antenna to receive a signal of DMB band.

Preferably, but not necessarily, the satellite integrated antenna may be realized to communicate through satellite frequency bands of GPS (Global Positioning System). Glonass, Galileo, XM and SIRIUS.

Preferably, but not necessarily, the satellite integrated antenna may be realized to further receive a signal of satellite radio frequency band.

Preferably, but not necessarily, the satellite integrated antenna may include a satellite radio reception antenna configured to receive a signal of satellite radio frequency band, and a satellite coordinate reception antenna positioned at the satellite radio reception antenna and configured to receive a signal of satellite radio frequency band.

Preferably, but not necessarily, a groove may be formed at the circuit board, and the groove is mounted with the satellite integrated antenna.

Preferably, but not necessarily, the shark fin antenna may be formed with two diplexers configured to combine and separate a signal received through the satellite radio reception antenna at a circuit board area formed with an electronic circuit connected to the satellite integrated antenna, and a signal received through the satellite coordinate reception antenna.

Advantageous Effects of the Disclosure

The shark fin antenna according to the exemplary embodiments of the present disclosure has an advantageous effect in that the shark fin antenna is formed with a combined structure of a circuit board and a plurality of antennas to enable a communication using various frequencies of telematics.

Furthermore, the plurality of antennas included in the shark fin antenna is arranged at an optimal position capable of obtaining isolation to thereby provide a high efficiency of communication performance.

Furthermore, the satellite integrated antenna mounted on the shark fin antenna is realized to communicate using satellite frequencies of GPS, Glonass, Galileo, XM and SIRIUS to thereby enable to provide a more accurate positioning service and to enable a platformization.

Furthermore, the shark fin antenna can guarantee a high efficiency of performance in a moving vehicle to provide the vehicle of a user and an adjacent vehicle desired by the user with various transmission/reception frequency signals in a wireless service.

Furthermore, the shark fin antenna is realized to obtain isolation between antennas and isolation in systems, whereby various services can be smoothly provided to a user by guaranteeing an excellent performance independent between antennas and systems, and by providing an excellent performance even during an operation where a transmission mode and a reception mode are simultaneously operated.

DETAILED DESCRIPTION

Advantages and characteristics of the present embodiment and methods for addressing the same will be clearly understood from the following embodiments taken in conjunction with the annexed drawings. However, the present disclosure is not limited to the embodiments and may be realized in various other forms. The embodiments are only provided to more completely illustrate the present disclosure and to render a person having ordinary skill in the art to fully understand the scope of the present disclosure. The scope of the present disclosure is defined only by the claims. Accordingly, in some embodiments, well-known processes, well-known device structures and well-known techniques are not illustrated in detail to avoid unclear interpretation of the present disclosure. The same reference numbers will be used throughout the specification to refer to the same or like parts.

Descriptions of well-known components and processing techniques may be omitted so as not to unnecessarily obscure the embodiments of the disclosure. The meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification. Hereinafter, exemplary embodiments of the present disclosure will be described in detail with reference to the accompanying drawings.

Figure 1:
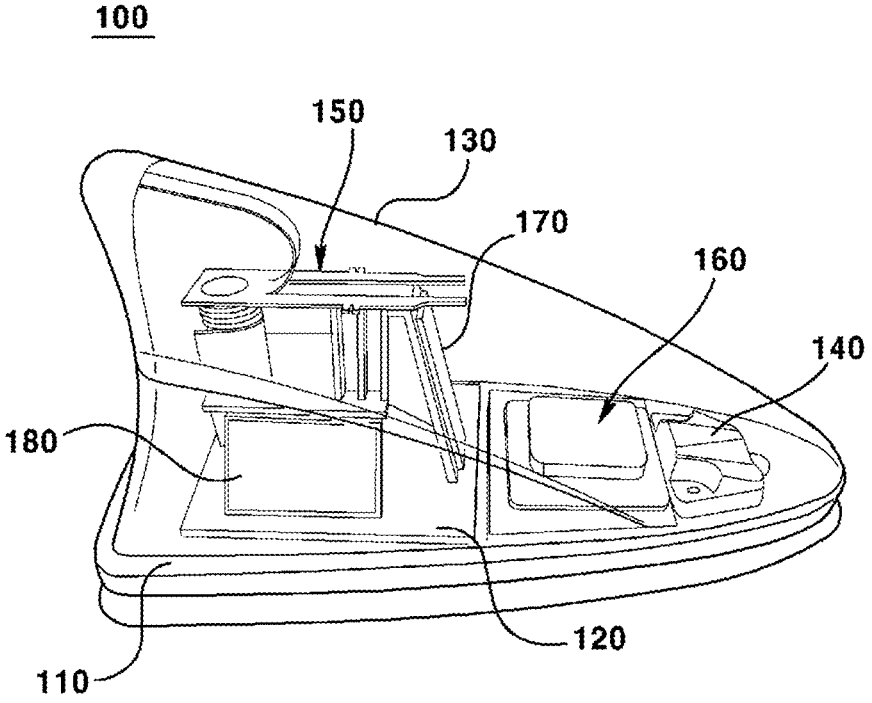
FIG. 1 is a perspective view illustrating a structure of a shark fin antenna according to an exemplary embodiment of the present disclosure.
Figure 2:
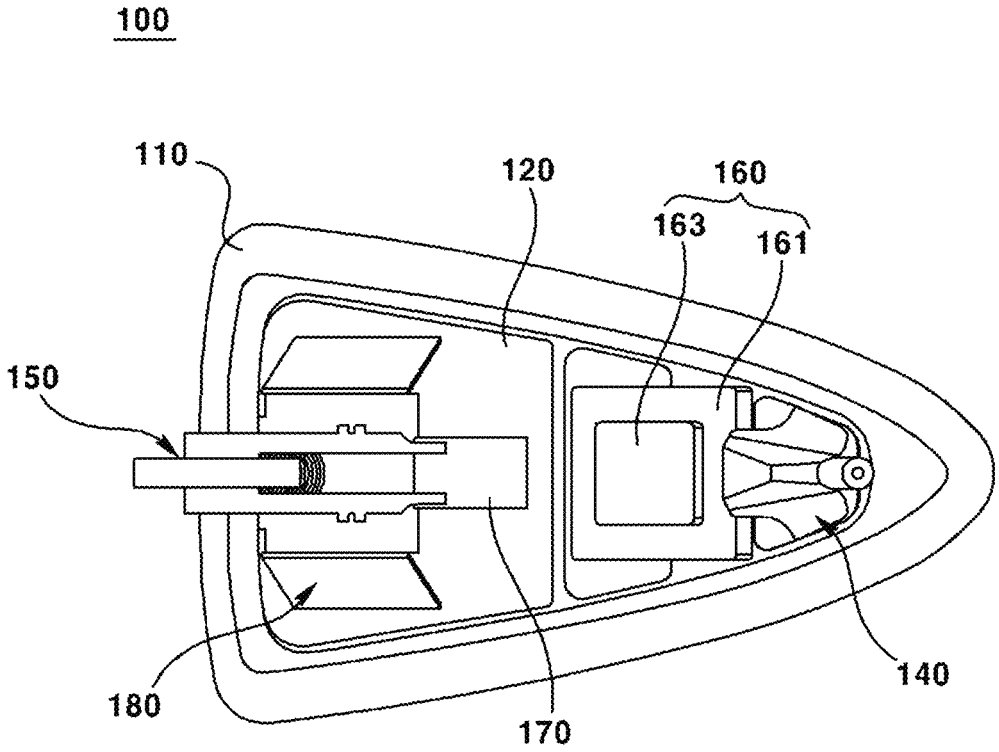
FIG. 2 is a plan view illustrating a structure of a shark fin antenna according to an exemplary embodiment of the present disclosure.
Figure 3A:
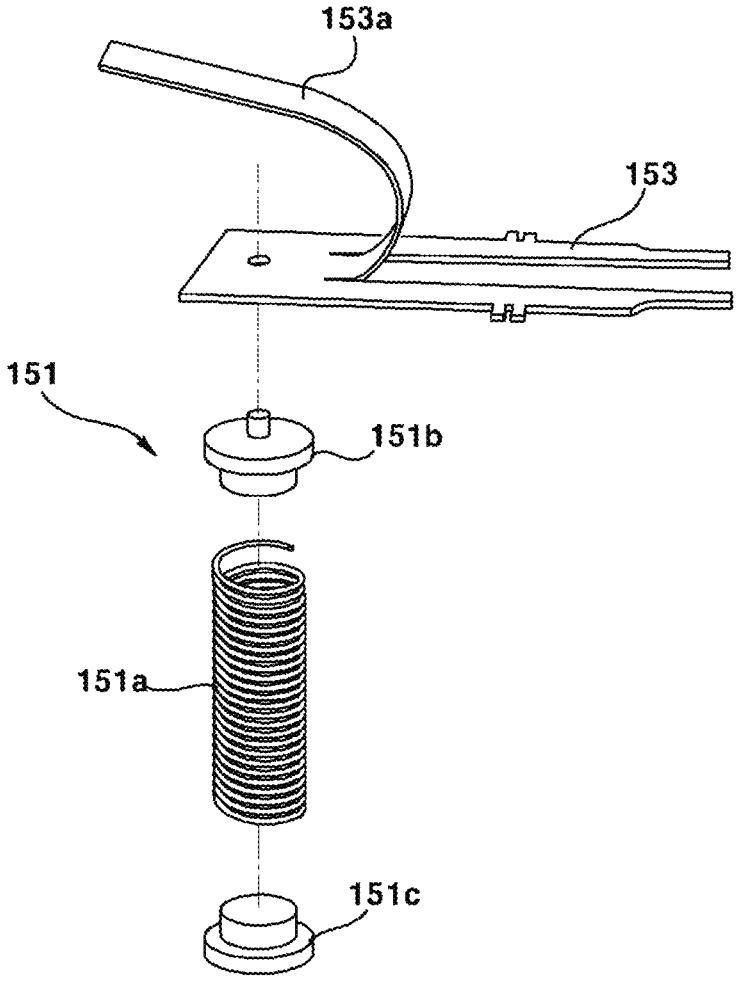
FIG. 3*a* is a separated perspective view illustrating a structure of AM/FM antenna according to an exemplary embodiment of the present disclosure.
Figure 3B:
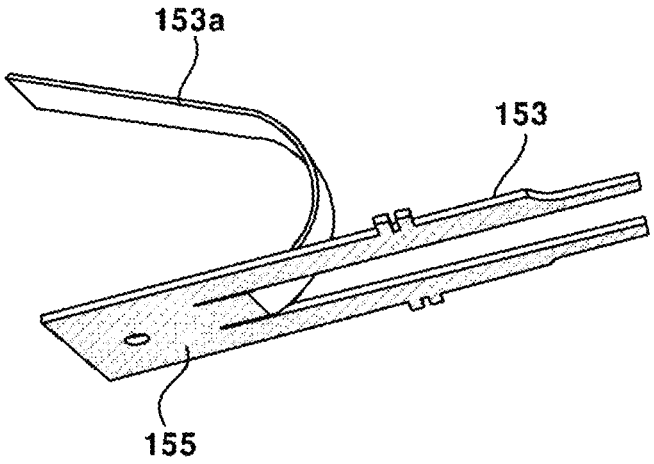
FIG. 3*b* is a schematic view illustrating a coupled state between a metal antenna of AM/FM antenna and a magnetic substance according to an exemplary embodiment of the present disclosure.
Figure 4:
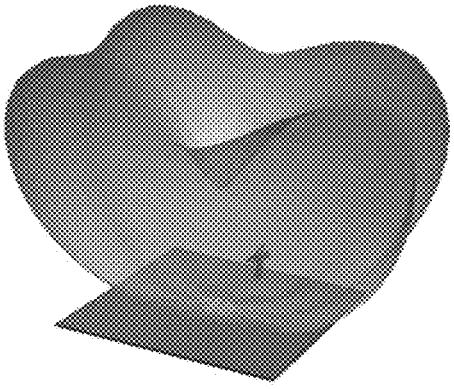
FIG. 4 is a schematic view illustrating a radiation pattern relative to a horizontally polarized wave of AM/FM antenna according to an exemplary embodiment of the present disclosure.
Figure 5:
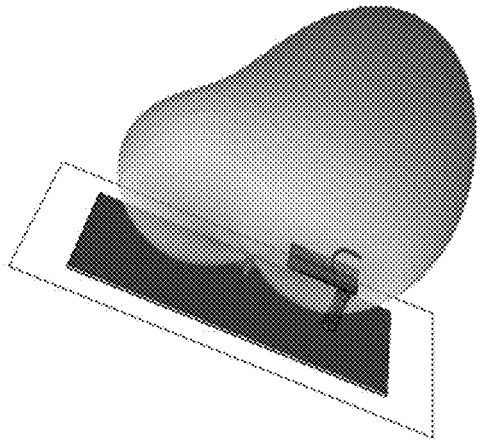
FIG. 5 is a schematic view illustrating a radiated pattern relative to a vertically polarized wave of AM/FM antenna according to an exemplary embodiment of the present disclosure.
Figure 6:
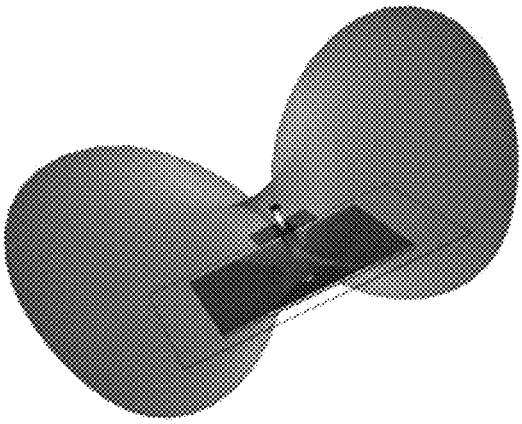
FIG. 6 is a schematic view illustrating an entire radiation pattern of AM/FM antenna according to an exemplary embodiment of the present disclosure.

FIG. 1 is a perspective view illustrating a structure of a shark fin antenna according to an exemplary embodiment of the present disclosure, FIG. 2 is a plan view illustrating a structure of a shark fin antenna according to an exemplary embodiment of the present disclosure, FIG. 3*a* is a separated perspective view illustrating a structure of AM/FM antenna according to an exemplary embodiment of the present disclosure, FIG. 3*b* is a schematic view illustrating a coupled state between a metal antenna of AM/FM antenna and a magnetic substance according to an exemplary embodiment of the present disclosure, FIG. 4 is a schematic view illustrating a radiation pattern relative to a horizontally polarized wave of AM/FM antenna according to an exemplary embodiment of the present disclosure, FIG. 5 is a schematic view illustrating a radiated pattern relative to a vertically polarized wave of AM/FM antenna according to an exemplary embodiment of the present disclosure, and FIG. 6 is a schematic view illustrating an entire radiation pattern of AM/FM antenna according to an exemplary embodiment of the present disclosure.

Figure 7:
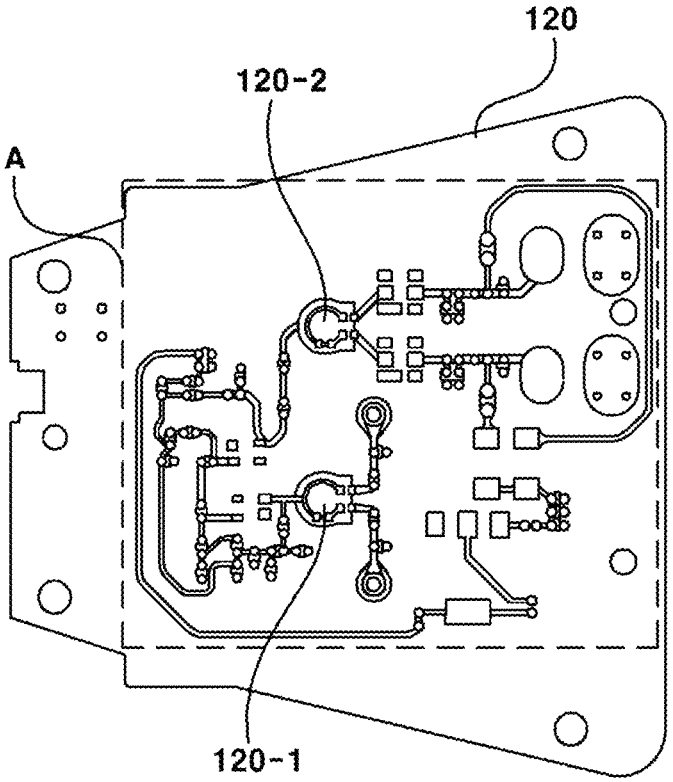
FIG. 7 is a schematic view illustrating a pattern of a circuit board area formed with an electronic circuit connected to a satellite integrated antenna according to an exemplary embodiment of the present disclosure.
Figure 8:
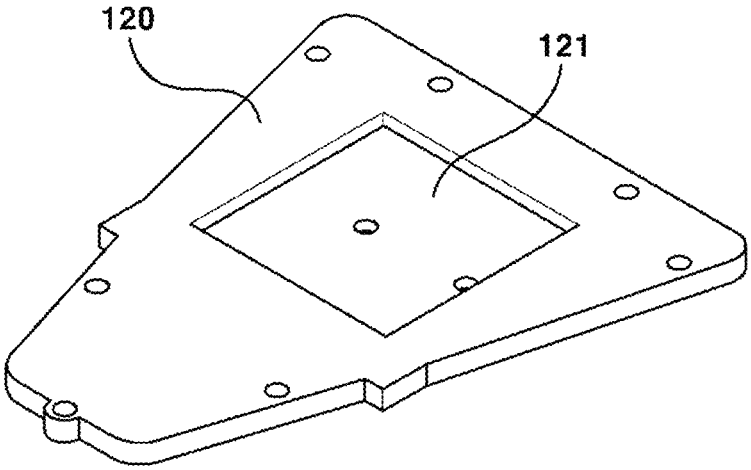
FIG. 8 is a schematic view illustrating a satellite integrated antenna-mounted groove on a circuit board according to an exemplary embodiment of the present disclosure.
Figure 9:
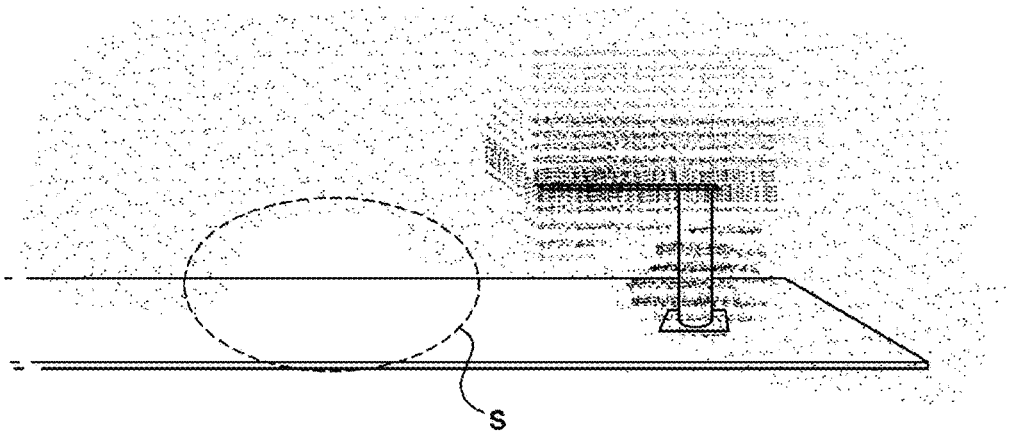
FIG. 9 is an exemplary view illustrating a shade area in a communication using AM/FM antenna.

FIG. 7 is a schematic view illustrating a pattern of a circuit board area formed with an electronic circuit connected to a satellite integrated antenna according to an exemplary embodiment of the present disclosure, FIG. 8 is a schematic view illustrating a satellite integrated antenna-mounted groove on a circuit board according to an exemplary embodiment of the present disclosure, and FIG. 9 is an exemplary view illustrating a shade area in a communication using AM/FM antenna.

Referring to FIGS. 1 and 2, a shark fin antenna (100) according to an exemplary embodiment of the present disclosure may include a base (110), a circuit board (120) mounted on the base (110), and a plurality of antennas mounted on the circuit board (120). The base (110) may provide a mounting space mounted with the circuit board (120) and the plurality of antennas.

In addition, the shark fin antenna (100) according to an exemplary embodiment of the present disclosure may further include a case (130) configured to cover the base (110). The circuit board (120) according to the present disclosure may be mounted with a 3G/4G antenna (140), an AM/FM antenna (150), a satellite integrated antenna (160), a DMB antenna (170) and a V2X (Vehicle to Everything) antenna (180), where some of these antennas may not be included, while antennas not mentioned herein may be further included.

The 3G/4G antenna (140) is an antenna so realized as to receive signals of 3G/4G bands, and can improve transmission/reception performances of various mobile-based wireless services in a vehicle inner environment. Meantime, the 3G/4G antenna (140) may be positioned at a first point of the circuit board (120), where the first point may be a point positioned at a front end of the circuit board (120), for example.

At this time, the 3G/4G antenna (140) may include two antennas of a main antenna and a sub antenna, each arranged at a left side and a right side based on a front end of the circuit board (120), and therefore can provide a smooth communication environment in a vehicle inner environment weak to a multipath fading.

Particularly, the AM/FM antenna (150) is an antenna configured to mostly perform a low frequency communication among antennas forming the shark fin antenna (100), and therefore, it is preferable that arrangement of the AM/FM antenna (150) be considered first and foremost. At this time, the AM/FM antenna (150) may be positioned at a second point of the circuit board (120), where the second point may be a point positioned at a rear end of the circuit board (120), for example.

Now, referring to FIGS. 3*a* and 3*b*, the AM/FM antenna (150) is realized to receive a signal of AM/FM bands, and may include a spring assembly (151), a metal antenna (153) and a magnetic substance (155). At this time, the spring assembly (151) may be vertically mounted on the circuit board (120), the metal antenna (153) may be coupled to an upper side of the spring assembly (151), and the magnetic substance (155) may be positioned at a bottom side of the metal antenna (153).

Because the magnetic substance (155) is positioned at a bottom surface of the metal antenna (153), interference of secondary radiation wave generated from a bottom end of the shark fin antenna when mounted to a vehicle can be interrupted and antennas can be miniaturized due to high magnetic permeability.

Furthermore, a part (153*a*) of the metal antenna (153) rises upwards by being bent in a U shape or a V shape to allow reinforcement of reception performance. Meantime, the spring assembly (151) may include a spring coil (151*a*), an upper electric conductor (151*b*) and a bottom electric conductor (151*c*). At this time, the bottom electric conductor (151*c*) may be coupled to a bottom side of the spring coil (151*a*) to receive a current necessary for radiation through the circuit board (120), and the upper electric conductor (151*c*) may be coupled to an upper side of the spring coil (151*a*) to be connected to the magnetic substance (155).

Meanwhile, a current is transmitted to a horizontal surface (E-field) from a part parallel from a horizontal surface of the metal antenna (153) to form a radiation pattern as illustrated in FIG. 4 in an AM/FM antenna (150) structure according to the present disclosure, whereby reception of horizontal polarized wave can be maximized. Furthermore, a radiation pattern is formed as illustrated in FIG. 5 to maximize reception of vertical polarized wave, because a current is perpendicularly (H-Field) transmitted due to a structure in which the spring assembly (151) is perpendicularly positioned to the metal antenna (153) and a structure in which a part (153*a*) of the metal antenna (153) is bent.

That is, the reception performance can be maximized because a radiation pattern is formed across an entire area of a vehicle as illustrated in FIG. 6, as a current is vertically and horizontally formed and rotated across an entire area of a vehicle roof by coupling of radiation pattern as illustrated in FIGS. 4 and 5.

The satellite integrated antenna (160) is an antenna configured to receive signals of satellite frequency band, and realized to receive signals of satellite frequency bands of many countries such as US, Europe, Russia, China and Japan. Furthermore, the satellite integrated antenna (160) may be realized to further receive signals of satellite radio frequency band.

Particularly, the satellite integrated antenna (160) may be realized to communicate through satellite frequency bands of GPS (Global Positioning System), Glonass, Galileo, XM, and SIRIUS. Furthermore, the satellite integrated antenna (160) may be a dielectric patch antenna capable of platformization and can enhance the performances of position-based services by receiving various satellite coordinates such as GPS and Galileo in receiving satellite coordinates. At this time, preferably, the satellite integrated antenna (160) may be positioned adjacent to the 3G/4G antenna (140), albeit being positioned between the 3G/4G antenna (140) and the AM/FM antenna (150).

Meantime, the satellite integrated antenna (160) may include a satellite radio reception antenna (161) configured to receive a signal of satellite radio frequency band, and a satellite coordinate reception antenna (163) configured to receive a signal of satellite frequency band.

At this time, a stacked structure is preferable for the satellite integrated antenna (160) to minimize a use area where the satellite radio reception antenna (161) is positioned at a bottom area and the satellite coordinate reception antenna (163) is positioned at an upper area. That is, as illustrated in FIG. 2, the circuit board (120) is positioned with the satellite radio reception antenna (161) and the satellite coordinate reception antenna (163) is positioned on the satellite radio reception antenna (161).

At this time, the circuit board (120) functions as a radiation plate of the satellite radio reception antenna (161) and the satellite radio reception antenna (161) functions as a radiation plate of the satellite coordinate reception antenna (163), such that an area of the satellite radio reception antenna (161) is preferably greater than that of the satellite coordinate reception antenna (163).

Furthermore, as illustrated in FIG. 7, the satellite integrated antenna (160) can be realized through a simple circuit configuration, using two diplexers (120-1, 120-2) configured to combine and separate a signal received through the satellite radio reception antenna (161) and a signal received through the satellite coordinate reception antenna (163) at a circuit board area (A) formed with an electronic circuit connected to the satellite integrated antenna (160).

In addition, when the satellite integrated antenna (160) is formed in a stacked structure of the satellite radio reception antenna (161) and the satellite coordinate reception antenna (163), there is a possibility of the performance (Axial ratio) of the satellite coordinate reception antenna (163) being degraded, and in order to solve the degradation problem, the circuit board (120) may be formed with a groove (121) at a position mounted with the satellite integrated antenna (160). At this time, the groove (121) may be mounted with the satellite radio reception antenna (161).

Data received by the satellite integrated antenna (160) is provided to a V2X system providing a service based on coordinate position, where the V2X system performs the V2X communication based on the satellite coordinate received by the satellite integrated antenna (160) to thereby guarantee an excellent vehicle performance.

The DMB antenna (170) is a meander-structured active antenna realized to receive a signal of DMB band. At this time, the DMB antenna (170) is formed in a structure coupled with a reception circuit, and is preferably positioned between the AM/FM antenna (150) and the satellite integrated antenna (160).

The V2X antenna (180) is a PCB (Printed Circuit Board) mounted type antenna useable in a small space and is realized for V2X communication. The V2X antenna (180) is a wide band antenna useable of Wi-Fi inside a vehicle by being coupled to a Wi-Fi system along with a V2X system due to advantageous coverage of V2X frequency band and Wi-Fi frequency band as well.

Meantime, the V2X antenna (180) is a 2T2R (two transmissions and two receptions) applicable to a vehicle safety and high speed communication, and one of the V2X antennas (180) is preferably arranged at a left side of the AM/FM antenna (150) and the other V2X antenna is arranged at a right side of the AM/FM antenna (150), each spaced apart at a predetermined distance, in order to communicate to all (front, rear, left, right, up and down) directions. Furthermore, the V2X antenna (180) may be independently used for other purposes in response to an RF system because of its being a wide band antenna.

As discussed in the foregoing, the shark fin antenna (100) may include a 3G/4G antenna (140), an AM/FM antenna (150), a satellite integrated antenna (160), a DMB antenna (170) and a V2X (Vehicle to Everything) antenna (180). The abovementioned antennas (140, 150, 160, 170, 180) are used for communication in mutually different frequency bands, and therefore, it is important that these antennas (140, 150, 160, 170, 180) be arranged at positions receivable of guarantees of excellent performances.

Referring to FIG. 9, when communication is conducted using the AM/FM antenna (150) used in the lowest frequency communication, there may be formed a space (S, AM/FM antenna shade area) where signals transmitted and received through the AM/FM antenna (150) are non-existent. Thus, when a shark fin antenna (100) is manufactured, it is preferable that the AM/FM antenna (150) be first and foremost arranged and other antennas (140, 160, 170, 180) be determined in positions later.

Meantime, it is preferred that antennas be sequentially arranged from low frequency communication antennas to high frequency communication antennas, such that the shade area of the AM/FM antenna (150) be positioned with the DMB antenna (170) and the satellite integrated antenna (160) be positioned at a shade area of the DMB antenna (170).

Thus, the shark fin antenna according to the present disclosure is formed with a combined structure of a circuit board and a plurality of antennas to enable a communication using various frequencies of telematics. Furthermore, the plurality of antennas included in the shark fin antenna is arranged at an optimal position capable of obtaining isolation, whereby a high efficiency of communication performance can be provided.

Furthermore, the satellite integrated antenna mounted on the shark fin antenna is realized to communicate using satellite frequencies of GPS, Glonass, Galileo, XM and SIRIUS to thereby enable to provide a more accurate positioning service and to enable a platformization.

Furthermore, the shark fin antenna can guarantee a high efficiency of performance in a moving vehicle to provide the vehicle of a user and an adjacent vehicle desired by the user with various transmission/reception frequency signals in a wireless service.

Furthermore, the shark fin antenna is realized to obtain isolation between antennas and isolation in systems, whereby various services can be smoothly provided to a user by guaranteeing an excellent performance independent between antennas and systems, and by providing an excellent performance even during an operation where a transmission mode and a reception mode are simultaneously operated.

Although the present disclosure has been described in detail with reference to the foregoing embodiments and advantages, many alternatives, modifications, and variations will be apparent to those skilled in the art within the metes and bounds of the claims. Therefore, it should be understood that the above-described embodiments are not limited by any of the details of the foregoing description, unless otherwise specified, but rather should be construed broadly within the scope as defined in the appended claims.

What is claimed is:

1. A shark fin antenna, the antenna comprising:

a base;

a circuit board mounted on the base;

a 3G/4G antenna mounted at a first end of the circuit board and configured to receive a signal of 3G/4G band signal;

an AM/FM antenna mounted at a second end of the circuit board and configured to receive an AM/FM band signal;

V2X (Vehicle to Everything) antennas mounted at a lateral surface of the AM/FM antenna, each being spaced apart at a predetermined distance and configured to realize V2X communication; and a plurality of antennas positioned between the 3G/4G antenna and the AM/FM antenna to receive a hand signal higher than the AM/FM band signal, but lower than the 3G/4G band signal, wherein the AM/FM antenna includes a spring assembly vertically mounted at the circuit board, a metal antenna coupled to an upper side of the spring assembly, and a magnetic substance positioned at a bottom side of the metal antenna, and wherein the metal antenna is configured in a manner such that a part of the metal antenna rises upwards by being bent into a U shape or a V shape.

2. The shark fin antenna of claim 1, wherein the plurality of antennas is mounted at a shade area, a space being that signals transmitted and received through the AM/FM antenna are non-existent.

3. The shark fin antenna of claim 1, wherein the 3G/4G antenna includes two horizontally-arranged antennas of a main antenna and a sub antenna.

4. The shark fin antenna of claim 1, wherein one of the V2X antennas is arranged at a left side of the AM/FM antenna and the other V2X antenna is arranged at a right side of the AM/FM antenna, each being spaced apart at a predetermined distance.

5. The shark fin antenna of claim 1, wherein the spring assembly includes a coil spring, a bottom electric conductor coupled to a bottom side of the coil spring to receive, from the circuit board, a current necessary for radiation, and an upper electric conductor coupled to an upper side of the coil spring and connected to the magnetic substance.

6. The shark fin antenna of claim 1, wherein the plurality of antennas includes a satellite integrated antenna mounted between the 3G/4G antenna and the AM/FM antenna to receive a signal of satellite frequency band.

7. The shark fin antenna of claim 6, wherein the plurality of antennas includes a DMB (Digital Multimedia Broadcasting) antenna mounted between the satellite integrated antenna and the AM/FM antenna to receive a signal of DMB band.

8. The shark fin antenna of claim 6, wherein the satellite integrated antenna is realized to communicate through satellite frequency bands of GPS (Global Positioning System), Glonass, Galileo, XM and SIRIUS.

9. The shark fin antenna of claim 6, wherein the satellite integrated antenna is realized to further receive a signal of satellite radio frequency band.

10. The shark fin antenna of claim 6, wherein the satellite integrated antenna includes a satellite radio reception antenna configured to receive a signal of satellite radio frequency band, and a satellite coordinate reception antenna positioned at the satellite radio reception antenna and configured to receive a signal of satellite radio frequency band.

11. The shark fin antenna of claim 6, wherein a groove is formed at the circuit board, and the groove is mounted with the satellite integrated antenna.

12. The shark fin antenna of claim 6, wherein the shark fin antenna is formed with two diplexers configured to combine and separate a signal received through the satellite radio reception antenna and a signal received through the satellite coordinate reception antenna at a circuit board area formed with an electronic circuit connected to the satellite integrated antenna.

* * * * *